US006705034B1

(12) United States Patent
Cahill

(10) Patent No.: US 6,705,034 B1
(45) Date of Patent: Mar. 16, 2004

(54) DISPLAY SYSTEM

(75) Inventor: Helen Thea Cahill, London (GB)

(73) Assignee: Snap Dragon Displays LTD, London (GB)

( * ) Notice: Subject to any disclaimer, the term of this patent is extended or adjusted under 35 U.S.C. 154(b) by 0 days.

(21) Appl. No.: 09/622,230

(22) PCT Filed: Feb. 9, 1999

(86) PCT No.: PCT/GB99/00402

§ 371 (c)(1),
(2), (4) Date: Aug. 15, 2000

(87) PCT Pub. No.: WO99/42024

PCT Pub. Date: Aug. 26, 1999

(30) Foreign Application Priority Data

Feb. 23, 1998 (GB) ..... 9803765
Oct. 27, 1998 (GB) ..... 9823495

(51) Int. Cl.[7] ..... A47G 1/06
(52) U.S. Cl. ..... 40/730; 40/732
(58) Field of Search ..... 40/729, 730, 732, 40/768, 611, 739, 741, 769, 158.1; 52/204.63

(56) References Cited

U.S. PATENT DOCUMENTS

| | | | | | |
|---|---|---|---|---|---|
| 923,394 | A | * | 6/1909 | Wildhack | 40/729 |
| 1,358,988 | A | * | 11/1920 | Rindsberger | 40/781 |
| 1,463,150 | A | * | 7/1923 | Carlsen | 40/790 |
| 1,747,053 | A | * | 2/1930 | Colerick | 254/19 |
| 1,971,923 | A | * | 8/1934 | Stern | 40/768 |
| 2,657,488 | A | * | 11/1953 | Knox | 40/732 |
| 2,737,742 | A | | 3/1956 | Leigh | 40/125 |
| 2,779,089 | A | * | 1/1957 | Allen | 29/254 |
| 3,132,432 | A | | 5/1964 | Yee | 40/152.1 |
| 3,169,010 | A | * | 2/1965 | Crawford, Jr. | 254/19 |
| 3,339,302 | A | * | 9/1967 | Mallory | 40/729 |
| 3,408,759 | A | * | 11/1968 | Rotheraine et al. | 40/732 |
| 3,471,959 | A | | 10/1969 | Seger | 40/152 |
| 3,523,382 | A | | 8/1970 | Dreyer | 40/152 |
| 3,529,374 | A | | 9/1970 | Spertus | 40/152 |
| 3,529,497 | A | * | 9/1970 | Brooks | 29/254 |
| 3,648,393 | A | | 3/1972 | Parrilla | 40/152 |
| 3,673,723 | A | * | 7/1972 | Lazar et al. | 40/152.1 |
| 3,673,724 | A | | 7/1972 | Bell et al. | 40/152 |
| 3,722,122 | A | | 3/1973 | Sesto | 40/152 |
| 3,791,012 | A | * | 2/1974 | Jenkin | 81/463 |
| 3,952,435 | A | | 4/1976 | Olsen | 40/152.1 |
| 4,017,989 | A | | 4/1977 | Murray | 40/152 |
| 4,043,477 | A | * | 8/1977 | Deese | 220/23.4 |
| 4,115,938 | A | | 9/1978 | Belmuth et al. | 40/152 |
| 4,145,827 | A | | 3/1979 | Katsufrakis | 40/152 |
| 4,244,303 | A | | 1/1981 | Kurasik | 109/23 |

(List continued on next page.)

FOREIGN PATENT DOCUMENTS

| | | |
|---|---|---|
| CA | 2089443 | 8/1994 |
| DE | 37 05 400 | 9/1988 |
| DE | G 90 02 403.6 | 3/1990 |
| EP | 0425609 | 12/1995 |
| GB | 470427 | 8/1937 |
| GB | 997264 | 7/1965 |
| GB | 1 400002 | 7/1975 |
| GB | 2296866 | 7/1996 |
| WO | WO 90/03753 | 4/1990 |
| WO | WO 97/42861 | 11/1997 |

*Primary Examiner*—Joseph D. Pape
*Assistant Examiner*—H. Gutman
(74) *Attorney, Agent, or Firm*—Woodcock Washburn LLP

(57) ABSTRACT

A frame for a sheet of a display material such as a photograph includes a backing support having a locating member to receive and locate the sheet of display material to be displayed, a transparent cover sheet for holding the display material in position while enabling the sheet to be visible and a holding member for holding the transparent cover sheet in position. The holding member is removable from the front to enable the transparent cover sheet to be removable for replacement of the sheet of display material from the front of the frame.

6 Claims, 2 Drawing Sheets

U.S. PATENT DOCUMENTS 4,385,459 A 5/1983 McGrath et al. ..... 40/124.4
4,432,152 A 2/1984 Daenen ..... 40/152.1
4,532,727 A 8/1985 Klose et al. ..... 40/152
4,566,211 A * 1/1986 Gustafson et al. ..... 40/605
4,608,770 A 9/1986 Gray ..... 40/152
4,669,341 A * 6/1987 Small ..... 81/418
4,704,814 A 11/1987 Astolfi ..... 40/152.1
4,706,397 A 11/1987 Hesener ..... 40/152
4,785,562 A 11/1988 Good ..... 40/159.1
4,827,639 A * 5/1989 Wang ..... 40/611
4,884,353 A * 12/1989 Taylor ..... 40/611
4,912,863 A * 4/1990 Harvey ..... 40/152
4,934,077 A * 6/1990 Gerlach ..... 40/730
4,939,858 A * 7/1990 Dailey ..... 40/732
4,949,483 A * 8/1990 Dobson et al. ..... 40/155
4,977,696 A * 12/1990 Johansson ..... 40/605
5,172,504 A * 12/1992 De Maat et al. ..... 40/605
5,195,263 A 3/1993 Huang ..... 40/152.1
5,267,403 A 12/1993 Hesner ..... 40/152
5,343,643 A * 9/1994 Cochrane ..... 40/732
5,375,351 A 12/1994 King et al. ..... 40/124.1
5,477,628 A * 12/1995 Chen ..... 40/155
5,483,762 A * 1/1996 Hogan ..... 40/768
5,544,438 A 8/1996 Fazekas ..... 40/605
5,588,240 A * 12/1996 Zilliox ..... 40/729
5,761,839 A * 6/1998 Heikkila ..... 40/777
5,784,817 A 7/1998 Behme ..... 40/748
5,799,429 A * 9/1998 Speshyock ..... 40/778
5,974,714 A * 11/1999 Jones ..... 40/768
6,054,968 A * 4/2000 De Matteo ..... 40/730
6,338,215 B1 * 1/2002 Vincent ..... 40/730

* cited by examiner

DISPLAY SYSTEM

BACKGROUND OF THE INVENTION

The present invention relates to frames for display of material such as photographs.

Many known photo frames are inconvenient in use because the photograph has to be inserted from the rear of the frame and it is not easy to ensure that the photograph is correctly positioned. This is a particular problem in the case where several photographs are linked together in a display on a wall and it becomes necessary to replace one of the photographs without removing the whole display. The problem also arises when a single photo frame is permanently attached to a wall or other display surface.

BRIEF SUMMARY OF THE INVENTION

The present invention is thus concerned with provision of a frame for display of photographs and other material where ease of operation is combined with an arrangement which is visibly pleasing.

As background art we refer to DE 90 02 403 U and CA-A-2 089 443 each of which discloses a picture frame which can be accessed from the front, whereas U.S. Pat. No. 4,432,152 shows a picture frame having spacing links and being accessible from the back.

This then creates the problem that if in a multiple display, only one of several pictures needs to be changed, it is necessary to take the whole display off the wall. The present invention aims to solve this problem.

Accordingly the invention provides a display system for display of a plurality of pictures in frames, comprising a plurality of similar frames and a plurality of spacing links which are arranged to connect adjacent frames to one another in a spaced relationship, each frame comprising a backing support having a locating means to receive and locate the sheet of display material to be displayed, a transparent cover sheet for holding said display material in position while enabling said sheet to be visible and a holding means for holding said transparent cover sheet in position, said holding means being removable from the front to enable said transparent cover sheet to be removable for replacement of said sheet of display material from the front of said frame.

The holding means can comprise corner pieces on the peripheral over frame, and these can be detachably attached by plastic snap-in inserts or by magnetic means to the backing support.

The backing support is preferably rectangular and includes at least two rectangular recesses to enable different sized sheets of display material to be accommodated for display. Thus different standard sizes of photographs can be accommodated.

When providing a display of linked similar frames, these can be held in a predetermined relationship. To achieve this, it is preferred to provide a series, for example five or seven, equi-spaced holes 12 along each side edge of the frame support, and spacing bars of substantially constant length can then be inserted in some of these holes, generally two per edge, to provide a linked display at predetermined spacings. The spacing bars can be held in the holes 12 via friction or with any well-known adhesive, for example.

A rectangular sheet of display material may be located by locating means defined by a shallow rectangular cavity of the same order of depth as the thickness of the display material.

In a preferred form of the invention the backing has at least two cavities of different sizes, for example different standard photograph sizes, where the smaller is located wholly within the larger in a stepped configuration. This enables different standard sizes of photographs to be accommodated within one frame, and in the case of the smaller photographs a border formed from part of the backing support will then normally be visible.

The invention therefore enables photographs or other material to be located quickly and easily from the front and to be held in place by removable pieces which can be designed to look pleasing in use. Moreover the rectangular cavity enables the photograph to be quickly and easily aligned.

BRIEF DESCRIPTION OF THE SEVERAL VIEWS OF THE DRAWING

An embodiment of the invention will now be described by way of example with reference to the accompanying diagrammatic drawings in which.

DETAILED DESCRIPTION OF THE INVENTION

Figure 1:
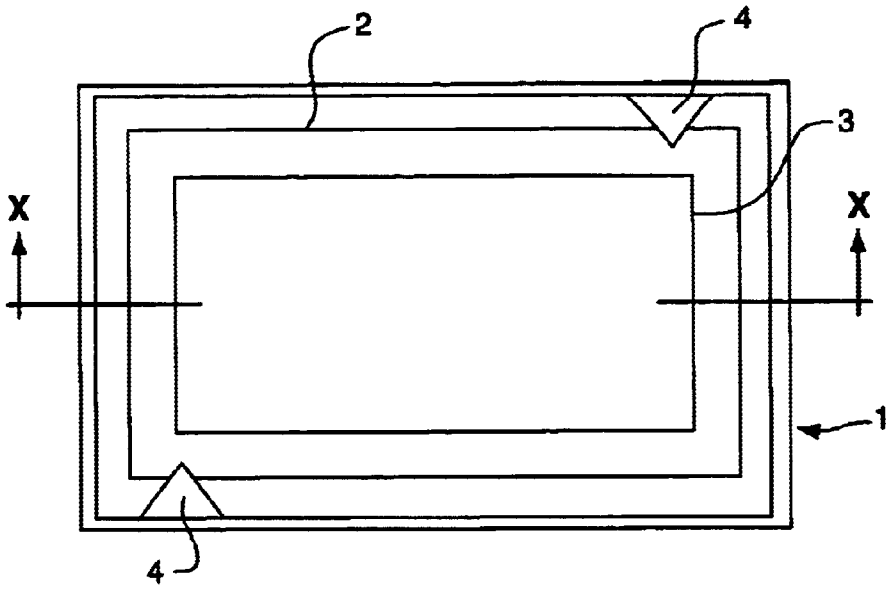
FIG. 1 is a plan view of a photo frame.
Figure 2:
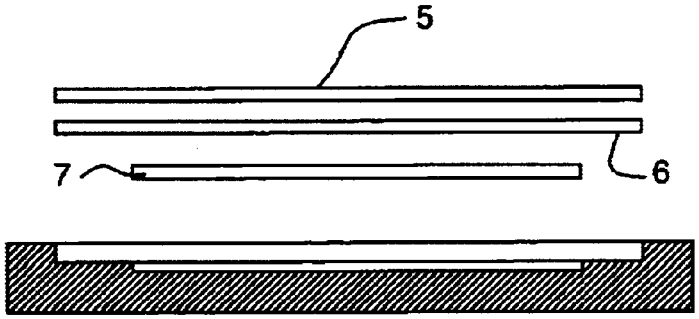
FIG. 2 is a section on the lines X—X of FIG. 1 in an exploded assembly position.

Referring to FIG. 1 a backing support 1 of black plastics material shown in section in FIG. 2 incorporates two rectangular cavities 2, 3 of different standard dimension corresponding to that of two standard photograph sizes 13×17.5 cm and 10.2×16.5 cm with the smaller wholly within the larger in a stepped configuration (see FIG. 2).

Figure 7:
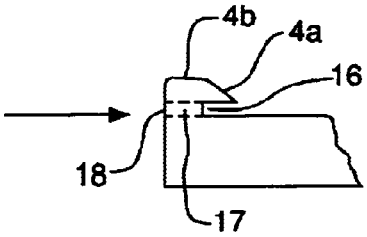
FIG. 7 is a fragmental view of part of the backing support.

Two triangular holding protuberances 4 are located in a peripheral groove 16 (not shown in FIG. 2) in an upstanding bead edge 4*a* of the frame support 1 (see FIG. 7), being inserted through a slot 17 formed through the beading 4*b* between the outer edge 18 of the frame and the peripheral groove 16. A transparent cover 5 (see FIG. 2) overlies one or other of two photographs 6, 7 depending on whether a larger or smaller photograph is to be displayed, and the respective larger or smaller photograph locates in the respective larger or smaller rectangular cavity 2 or 3.

Thus in use, one or other of the photographs is placed in the appropriate shallow cavity, the transparent plastic or glass cover 5 is placed over the photograph and then the holding protuberances 4 are finally pushed into position by being inserted through the beading 4*b* from the outside (see arrow in FIG. 7) to hold the photograph together.

Figure 3:
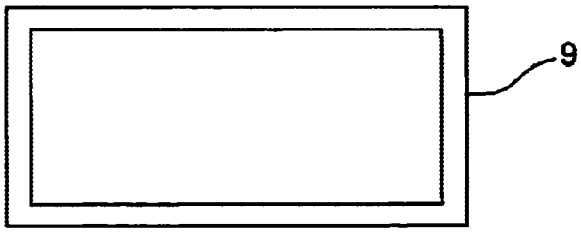
FIG. 3 is a view of a peripheral over frame.
Figure 8:
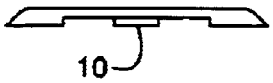
FIG. 8 is a sectional side view of the FIG. 3 peripheral over frame.

Referring to FIGS. 3 and 8, a peripheral over frame 9 as an alternative to the protuberances 4 is used to hold the transparent cover 5 in position. This can be achieved by use of magnets 10 adhering to a metallic section of the backing frame or by plastic snap-in inserts on the underside (see FIG. 8).

Figure 4:
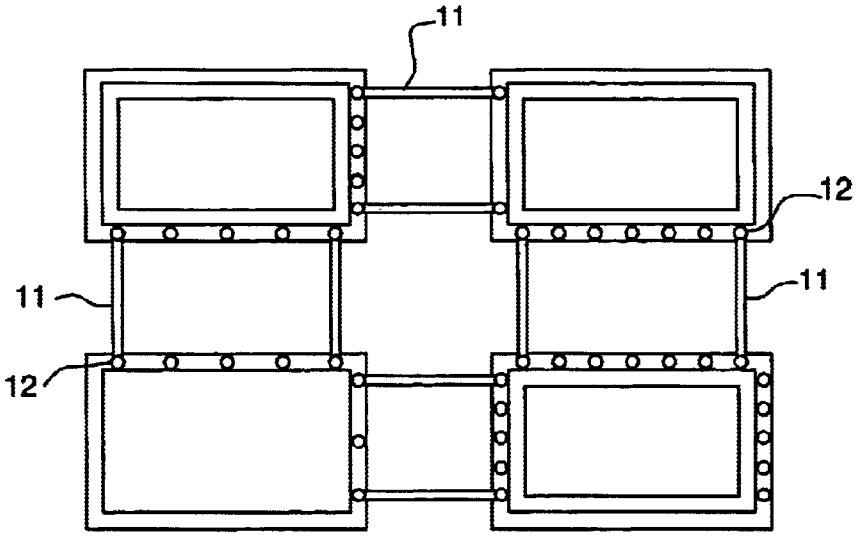
FIG. 4 shows a display of linked photo frames.
Figure 6:
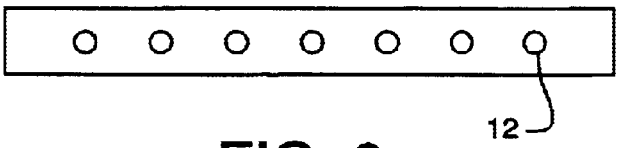
FIG. 6 is an edge view of the backing support.

In practice there is a mounting means such as a plurality of semi-circular holes 12 in each side edge of the photograph frame (see FIG. 6). This enables the frame to be mounted or supported in various ways. For example, a number of frames can be displayed in these holes 12 for linking to spaced adjacent photographs (see FIG. 4), or hooks can be inserted in the holes 12 for mounting the frame on a wall.

Figure 5:
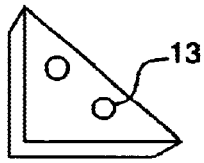
FIG. 5 is a perspective view of a corner piece.

Finally FIG. 5 shows a third means of holding the glass cover in place. This consists of four triangular pieces having snap-in inserts 13 On their undersides which fit in corresponding holes (not shown) on corner regions of the upper face of the backing support 1.

What is claimed is:

1. A display system for display of a plurality of pictures, the display system comprising:

a plurality of display frames, each of said display frames comprising:

a respective backing support having at least one recess including inwardly-facing surfaces for continuously surrounding and locating a sheet of display material, a respective transparent cover sheet for holding said sheet of display material in said at least one recess, and at least one respective releasable securer for holding said transparent cover sheet in position, said at least one releasable securer being removable to allow removal of the transparent cover sheet from the front of said display frame to enable replacement of said sheet of display material from the front of said frame; and a plurality of elongated spacing links each having a respective end thereof, said elongated spacing links being connectable at the respective ends thereof to respective ones of said display frames to secure said display frames to one another in a spaced relationship, wherein each of said display frames has a respective plurality of outwardly-facing side surfaces, and wherein respective mounting means is provided in said outwardly-facing side surfaces for receiving the respective ends of said spacing links for securing said display frames to one another, wherein at least one of said respective backing supports includes at least two rectangular edge-defining recesses to enable differently sized sheets of display material to be accommodated for display.

2. The display system according to claim 1, comprising at least two securers, each said securer being an edge protuberance overlapping said transparent cover sheet and being arranged to be located in a slot of the backing support.

3. A display frame, for use in a display system comprising a plurality of said display frames and a plurality of elongated spacing links each having a respective end thereof, said elongated spacing links being connectable at the respective ends thereof to respective ones of the display frames to secure the display frames to one another in a spaced relationship, the display frame comprising:

a backing support having at least two rectangular edge-defining recesses each said edge-defining recess including respective inwardly-facing surfaces for continuously surrounding and locating a respective sheet of display material to be displayed, wherein the rectangular edge-defining recesses are of different sizes;

a transparent cover sheet for holding said sheet of display material in said at least one recess;

at least one releasable securer for holding said transparent cover sheet in position, said at least one releasable securer being removable to allow removal of the transparent cover sheet from the front of said display frame to enable replacement of said sheet of display material from the front of said display frame; and a plurality of outwardly-facing side surfaces, wherein respective mounting means is provided in said outwardly-facing side surfaces for receiving the respective ends of said elongated spacing links for securing said display frames to one another.

4. A display system for display of a plurality of pictures, comprising:

a plurality of display frames, each of said display frames comprising:

a respective backing support having at least one recess including inwardly-facing surfaces for continuously surrounding and locating a sheet of display material, a respective transparent cover sheet for holding said sheet of display material in said at least one recess, and at least one respective releasable securer for holding said transparent cover sheet in position, said at least one releasable securer being removable to allow removal of the transparent cover sheet from the front of said display frame to enable replacement of said sheet of display material from the front of said display frame; and a plurality of elongated spacing links each having a respective end thereof, said elongated spacing links being connectable at the respective ends thereof to respective ones of said display frames to secure said display frames to one another in a spaced relationship, wherein each of said display frames has a respective plurality of outwardly-facing side surfaces, and wherein respective mounting means is provided in said outwardly-facing side surfaces for receiving the respective ends of said elongated spacing links for securing said display frames to one another, wherein at least one of said respective backing supports includes at least two rectangular edge-defining recesses to enable differently sized sheets of display material to be accommodated for display.

5. The display system according to claim 4, wherein said holding means comprises at least two edge protuberances each overlapping said transparent cover sheet and being arranged to be located in a slot of the backing support.

6. A display frame according to claim 3, comprising:

at least two of said releasable securers, each of said at least two respective releasable securers being an edge protuberance overlapping said transparent cover sheet and being arranged to be located in a slot of the backing support.

* * * * *

UNITED STATES PATENT AND TRADEMARK OFFICE

CERTIFICATE OF CORRECTION

PATENT NO. : 6,705,034 B1
DATED : March 16, 2004
INVENTOR(S) : Helen Thea Cahill It is certified that error appears in the above-identified patent and that said Letters Patent is hereby corrected as shown below:

Column 2,
Line 43, after "Two" insert -- releasable securers such as -- therefor.

Signed and Sealed this

Twenty-second Day of November, 2005

JON W. DUDAS
*Director of the United States Patent and Trademark Office*